United States Patent [19]

George

[11] Patent Number: 4,556,210

[45] Date of Patent: Dec. 3, 1985

[54] HIGH SPEED DUPLICATOR WITH COPY SHEET PRE-LOADING RECEPTACLE

[75] Inventor: Clifford L. George, Macedon, N.Y.

[73] Assignee: Xerox Corporation, Stamford, Conn.

[21] Appl. No.: 563,730

[22] Filed: Dec. 21, 1983

[51] Int. Cl.[4] ..... B65H 1/26

[52] U.S. Cl. ..... 271/157; 206/449; 271/162

[58] Field of Search ..... 271/157, 149, 145, 146, 271/147, 152, 153, 154, 155, 156, 158, 159, 160, 162, 163, 164, 165, 3.1; 414/403, 118; 221/198, 281; 206/449, 555, 556; 53/381 R

[56] References Cited

U.S. PATENT DOCUMENTS 3,741,537 6/1973 Lange ..... 271/165

FOREIGN PATENT DOCUMENTS 0038241 3/1982 Japan ..... 271/3.1

839786 6/1960 United Kingdom ..... 271/61

*Primary Examiner*—Bruce H. Stoner, Jr.

*Assistant Examiner*—Matthew C. Graham

*Attorney, Agent, or Firm*—Bernard A. Chiama

[57] ABSTRACT

A sheet supply receptacle is disclosed which permits the operator to prepare many reams of sheets of paper for use in a very high speed copier/duplicator. The receptacle, when pre-loaded with reams of paper, is adapted to be applied to the sheet supply apparatus of the copier/duplicator, to deposit the reams on the sheet supply tray or elevator for the copier/duplicator in proper sheet feeding registration and alignment, and be removed from the sheet supply apparatus to be reloaded again for another loading operation.

1 Claim, 6 Drawing Figures

HIGH SPEED DUPLICATOR WITH COPY SHEET PRE-LOADING RECEPTACLE

This invention relates to a high productivity reproduction system, or copying machine, having copy sheet supply arrangements involving very large quantities of copy sheets for use in such system.

With the advent of higher speed and more sophisticated copy producing machines, printing presses, and the like, considerations as to how the mass of copies generated can best and most effectively by handled has assumed increasing importance. For high productivity copies or duplicators, copy sheet supply apparatus utilize supply trays which are adapted to hold three to five and even more reams of copy sheets. This type of copy sheet supply requires the operator to load the paper supply tray with a plurality of reams of copy sheets, one ream at a time, thereby necessitating repeatedly shutting down the copier or duplicator so as to permit loading of the sheet supply tray with individually handled reams of sheets. This entailed unpackaging individual reams and placing each ream on the elevator platform for the sheet supply using caution that each ream of sheets is correctly placed on an earlier placed ream. Building up a supply tray holding five or more reams involved time which required machine shutdown and consequently loss of productivity as well as requiring many manipulative steps by the operator to accomplish.

It is, therefore, the object of the present invention to permit the loading of a very high speed copier or duplicator with reams of copy sheets quickly and easily to eliminate copier shutdown for this purpose.

The present invention includes a copy sheet container capable of being pre-loaded with a plurality of reams of copy sheets, and which container may be applied directly to the sheet supply for a copier/duplicator.

Other objects and advantages will be apparent from the ensuing description and drawings in which.

Figure 1:
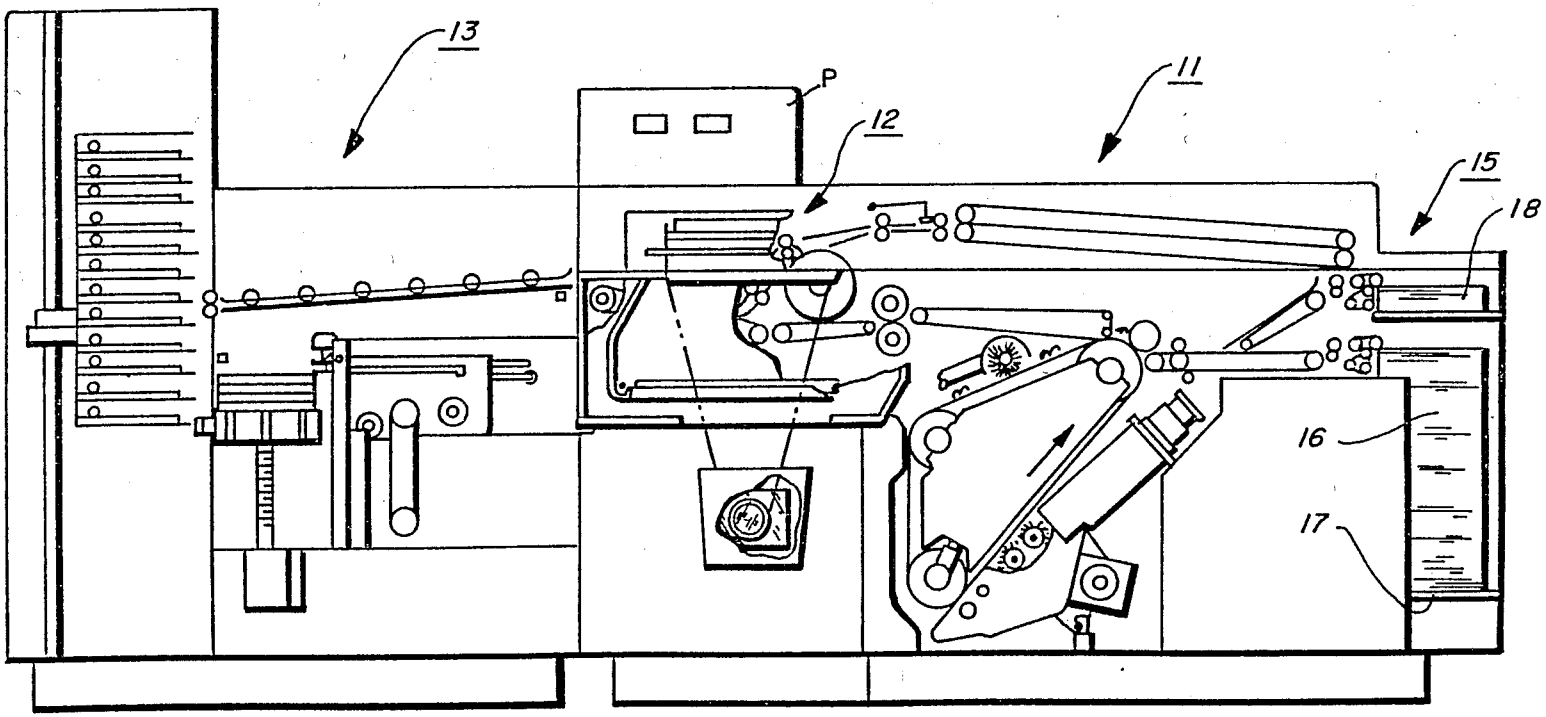
FIG. 1 is a schematic illustration of a configuration of an electrostatographic printing system to which the present invention may be utilized.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commerical embodiment of the Xerox duplicators, models 9400 and 9500 which utilize flash, full frame exposure, for very high speed production. Similarly, the document handling apparatus 12 is the same as those used in the same machines. It will be understood that most any other type of xerographic processor and multiple exposure document handling apparatus may be utilized. Operating in conjunction with the processor 11 and apparatus 12 is a finishing station 13 and thereby forms the reproduction system shown in FIG. 1.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all the necessary functions in the reproduction system.

The copier/duplicator system shown in FIG. 1 is representative of systems which are capable of producing 120 and more image impressions per minute. For simplex or one sided copying, this can result in producing 120 copies per minute or more. In order to accomplish fairly long reproduction runs, the main copy sheet supply subsystem for the system, the main copy sheet holding tray is adapted to hold five or more reams of sheets. At 500 sheets per ream, five reams totals out to involve 2500 sheets. At a production rate of 120 copies per minute, it can be estimated that five reams will last approximately 21 minutes before needing reloading. For a long run, it can be envisioned that an operator will spend considerable time reloading the main sheet supply tray.

Reloading five reams requires that the copying system be shut down, that each ream must be broken open and the sheets accurately positioned on the tray bottom for the sheet supply tray, which is usually an elevator platform. Generally, these platforms are only inches from the floor and are deeply recessed into the copier housing thus necessitating many cycles of up and down bending and leaning of the operator's body to accomplish a little over 21 minutes of copier use before another cycle of reloading will be required. The present invention is directed to a sheet holding receptacle or tray which is particularly suited to be momentarily installed upon the sheet supply tray of a copier and be provided with a removable bottom plate upon which reams of copy sheets were previously placed so that upon removal of the bottom plate, the pre-loaded copy sheets will be placed upon the supply tray in proper orientation and in a neat stack.

In this manner, the sheet holding tray in the present invention may be pre-loaded while the copier is running so that upon a low paper condition of the copier, the same can be switched over to the use of an auxiliary sheet supply while five new reams of sheets can be quickly added. Several such trays may be loaded and held in reserve for future runs in place of boxes of packaged reams as is usually the case.

Figure 2:
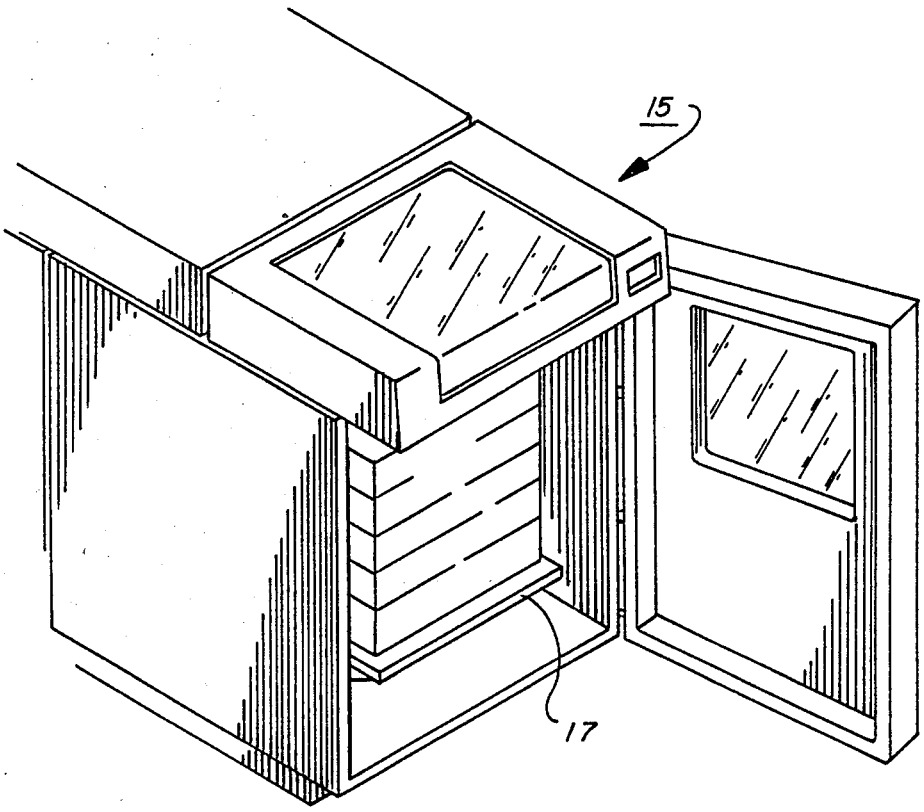
FIG. 2 is an isometric of the copy sheet loading station for the system of FIG. 1.

As shown in FIGS. 1 and 2, the copier/duplicator system 11, 12 and 13 is typically provided with a copy sheet supply station 15 at one end of the system. This station may include a main sheet supply 16 having an elevator 17 which serves as the support or holding tray for five or more reams of copy sheets, and an auxiliary tray 18 which may contain one ream. In the conventional manner, as shown in FIG. 2, the main sheet supply includes elevator 17 upon which five or more reams of copy sheets are placed.

Figure 3:
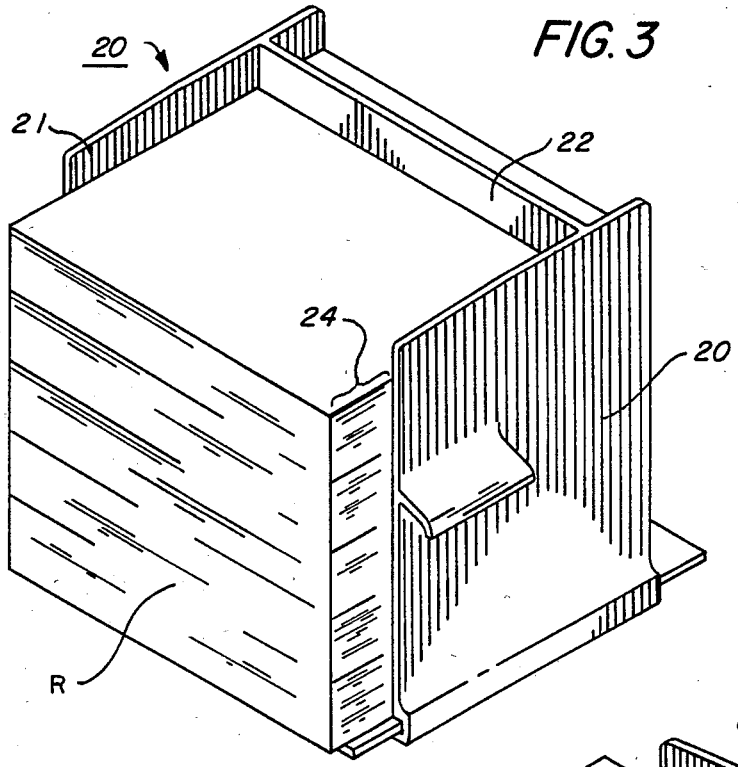
FIG. 3 is an isometric of a copy sheet loading tray in accordance with the present invention.
Figure 4:
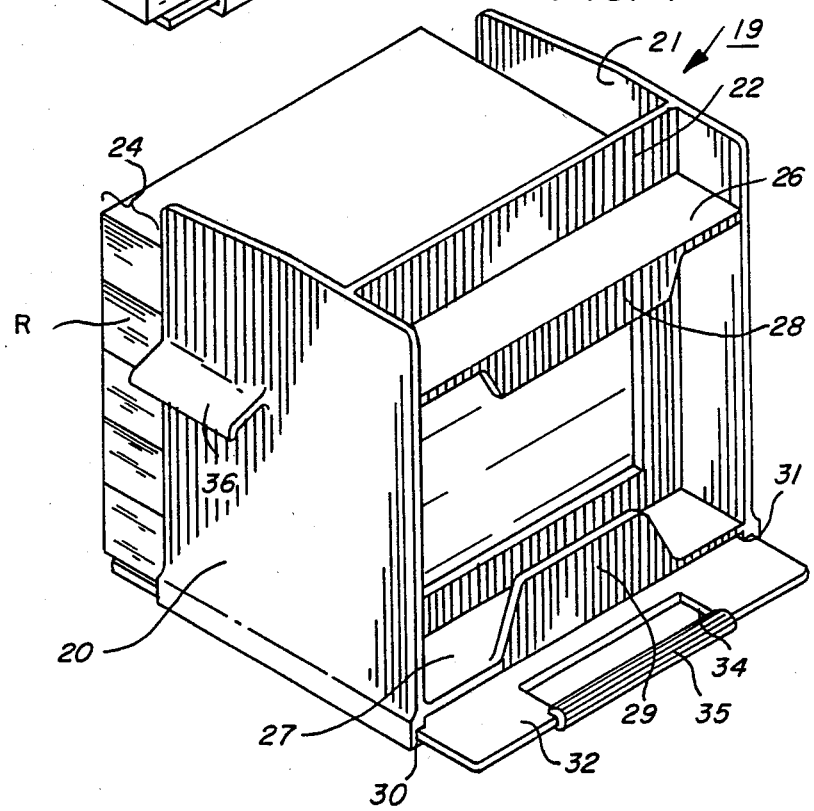
FIG. 4 is an isometric of the tray taken from another side thereof.

The pre-loading sheet supply receptacle of the present invention is shown in FIGS. 3 and 4 and denoted generally by the reference numeral 19. The receptacle includes two side parallel-spaced panels 20, 21, between which five or more reams of copy sheets R may be positioned to be in edge contact therewith. A back panel 22 is connected to both side panels and engages a third edge of the reams R when these are loaded in the receptacle. The positioning of the back panel 22 is such as to be about a quarter of the distance inward from the rear edges of the side panels 20, 21. The dimension of all of the panels is preferably chosen so that with reams of sheets against all of the panels, a portion of the reams, identified by the reference numeral 24, extend beyond the forward edges of the panels. The extending portion of the copy sheets thereby allows the sheets to be applied to the sheet separating and feeding mechanisms of the copier/duplicator system when a pre-loaded receptacle 19 is placed in the system for use.

As shown in FIG. 4, a short width panel 26 is secured to the inner sides of the side panels 20, 21 and to the back side of the back panel 22. Similarly, a short width panel 27 joins the side panels at their bottom edge, and is secured to the lower edge of the back panel 22. These narrow panels serve as strengthening support for the side and back panels. A depending portion 28 from the panel 26 and an upturned portion 29 of the panel 27 are suitable formed to serve as handles, as will be described below.

The lower edges of the side panels 20, 21 are formed with inwardly facing square grooves 30, 31, respectively, which are parallel to each other and are of the same cross-sectional shape. Slidably received in these grooves is a support plate 32 which extends beyond the widths of the side panels 20, 21 in both directions. The support plate 32, when in sliding engagement with the grooves 30, 31 is adapted to support the reams of sheets placed in the receptacle.

The length of the plate is such as to underlie and support the sheets which extend within the portions 24, at the forward end of the plate, and to extend a distance beyond the rear of the receptacle to provide an access opening 34. Across the access hole, a handle 35 is secured for operator use. To complete the structure of the receptacle 19, handles 36 are formed on the side panels 20, 21 to permit an operator to lift the receptacle, after loading with reams of sheets and to carry to the sheet supply station 15 and to position the receptacle therein.

Figure 5:
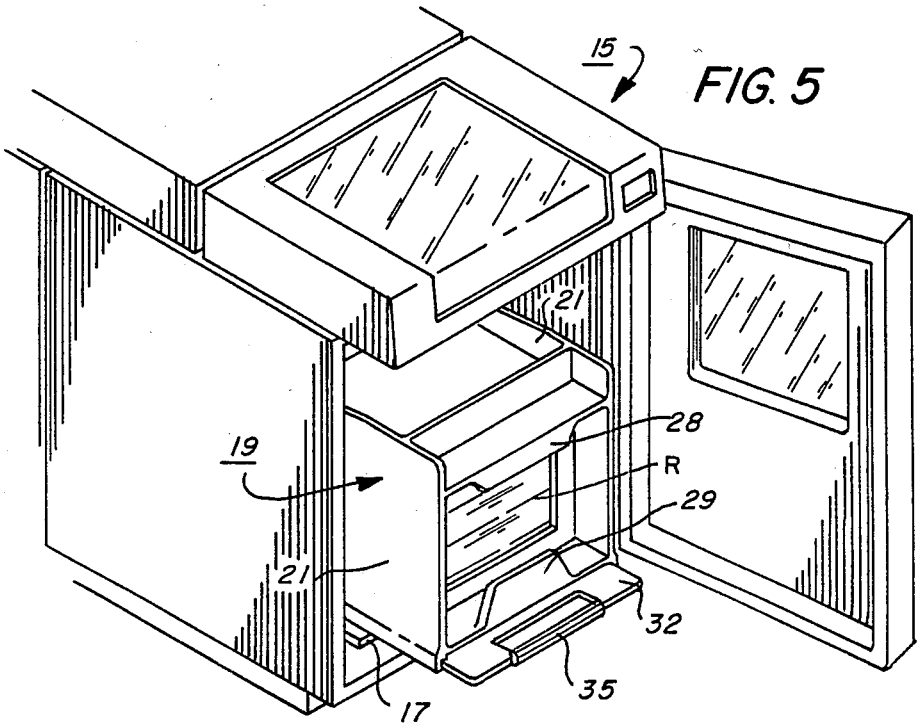
FIG. 5 is an isometric of the tray of FIG. 3 shown being applied to the loading station of the system of FIG. 1.
Figure 6:
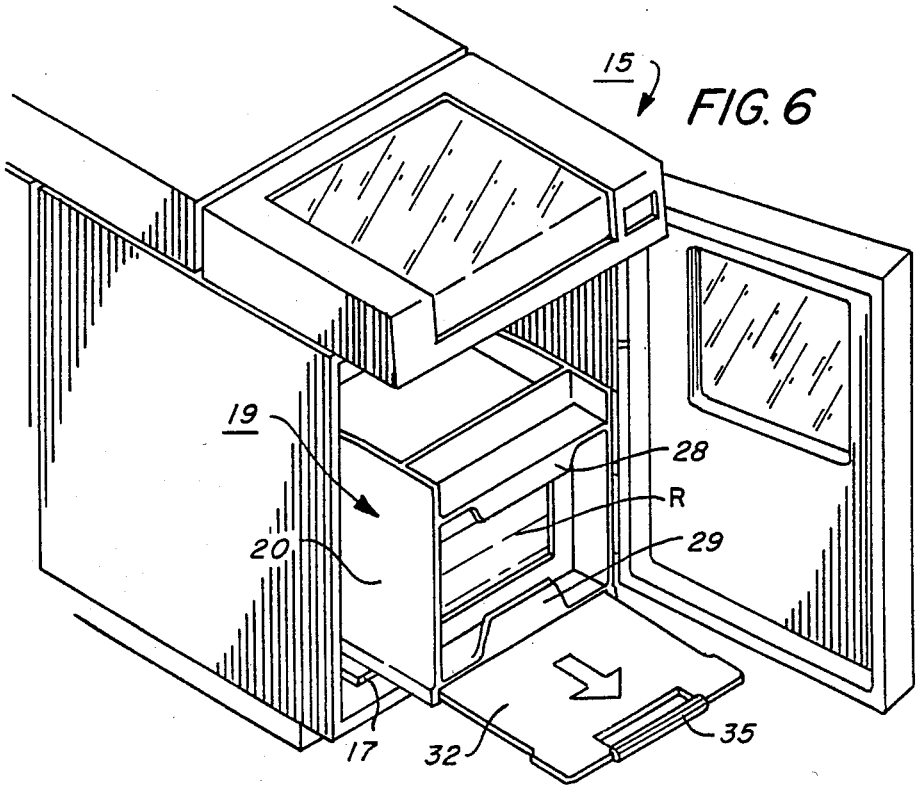
FIG. 6 is an isometric of the tray showing reams of paper being loaded on to the elevator for the system of FIG. 1.

In operation, after the operator has pre-loaded the receptacle 19 with the proper number of reams of copy sheets, the receptacle is placed on the main sheet supply elevator or tray 17, as shown in FIG. 5. The pre-positioning of the receptacle structure is such that in this position, the sheet stack separator and feed devices may effectively operate upon the sheets. The operator then quickly slides the bottom support plate 32, as shown in FIG. 6 using the handle 35 from under the reams of sheets. This action causes the reams to lower the thickness of the plate 32 and to be placed on the elevator 17. The receptacle 19 may then be easily removed from the station 15 by use of the handles since the weight of the reams is no longer a factor. The lower edges of the side plates 20, 21 merely slide outwardly upon the elevator 17.

While the invention has been described with reference to the structure disclosed, it is not confined to the details set forth, but is intended to cover such modifications or changes as may come within the scope of the following claims.

I claim:

1. In a copier/duplicator having a sheet feeding apparatus, a sheet supply platform for supporting copy sheets and adapted to cooperate with the feeding apparatus to apply the sheets to the sheet feeding apparatus, the combination comprising, a receptacle having a bottom element for supporting a stack of reams of sheets of paper and at least two side panels having lower ends and against which the reams of sheets are placed for registration and alignment, said receptacle being adapted to be manually positioned upon the platform for the sheet feeding apparatus with said lower ends of the side panels placed on top of the platform and with the top of the stack of reams in operating association with the sheet feeding apparatus, said side panels having means formed on said lower ends thereof for slidably receiving said bottom element, means for permitting the operator to slidably remove the bottom element relative to said side panels and therefore from said receptacle and thereby effect the placement of the stack of reams of sheets upon the sheet supply platform, and means for permitting the operator to slide said lower ends of said side panels relative to and away from the platform and thereby effect the removal of said receptacle from the copier/duplicator leaving the stack of reams remaining on the platform.

* * * * *